US008450661B2

(12) United States Patent
Ito et al.

(10) Patent No.: US 8,450,661 B2
(45) Date of Patent: May 28, 2013

(54) METHOD OF MANUFACTURING HEAT-GENERATING PANEL, HEAT-GENERATING PANEL MANUFACTURED BY THE SAME, PANEL-SHAPED STRUCTURE, AND HEAT-GENERATING SYSTEM

(75) Inventors: Toshiaki Ito, Gunma (JP); Takakazu Sawada, Saitama (JP); Etsuo Hino, Saitama (JP); Yasutoshi Honda, Saitama (JP); Gaku Okuno, Saitama (JP); Katsunobu Yamanaka, Saitama (JP); Muneyuki Tanaka, Tokyo (JP); Yoshikazu Dammura, legal representative, Tokyo (JP)

(73) Assignee: Figla, Co., Ltd., Tokyo (JP)

( * ) Notice: Subject to any disclaimer, the term of this patent is extended or adjusted under 35 U.S.C. 154(b) by 176 days.

(21) Appl. No.: 13/002,970

(22) PCT Filed: Jul. 8, 2008

(86) PCT No.: PCT/JP2008/062328
§ 371 (c)(1),
(2), (4) Date: Jan. 6, 2011

(87) PCT Pub. No.: WO2010/004617
PCT Pub. Date: Jan. 14, 2010

(65) Prior Publication Data

US 2011/0114631 A1 May 19, 2011

(51) Int. Cl.
*H05B 3/02* (2006.01)
*H01C 17/00* (2006.01)

(52) U.S. Cl.
USPC ..... 219/538; 29/610.1

(58) Field of Classification Search
USPC ..... 219/520–522, 538, 541–544; 65/42, 65/54, 59.1, 60.1; 29/610.1, 611, 619; 156/272.2, 273.3, 273.5, 273.7, 320–322
See application file for complete search history.

(56) References Cited

U.S. PATENT DOCUMENTS 3,516,154 A * 6/1970 Wainwright et al. ..... 29/611
4,718,932 A * 1/1988 Pharms ..... 65/42

(Continued)

FOREIGN PATENT DOCUMENTS

JP 06-23862 3/1994
JP 09-161953 6/1997
JP 2000-260555 9/2000

(Continued)

OTHER PUBLICATIONS

International Search report from PCT Application No. PCT/JP2008/062328 mailed Sep. 9, 2008.

*Primary Examiner* — Sang Paik
(74) *Attorney, Agent, or Firm* — Lando & Anastasi, LLP

(57) ABSTRACT

A method of manufacturing a heat-generating panel 100 having a configuration in which an electrically-conductive thin layer 120 is provided on at least one surface of a translucent plate 110 and the electrically-conductive thin layer 120 is caused to generate heat by supplying electric power to the same. The method comprises fixing a metal strip 132 onto the electrically-conductive thin layer 120 formed on the plate 110 along each of opposing sides of the plate 110; applying an electrically-conductive paste 134 over each of the metal strips 132 to cover the same; contacting a heat-generating portion 220 of the heating device 200 at edges forming the two sides of the plate 110 where the metal strip 132 is fixed in a state in which a temperature of the heat-generating portion 220 is above a predetermined temperature, the heat-generating portion 220 being longer than at least a full length of the metal strip 132, and curing the electrically-conductive paste 134 to form electrodes having the metal strip and the electrically-conductive paste 134; and connecting a conductor wire 140 electrically to each of the electrodes 130.

2 Claims, 16 Drawing Sheets

U.S. PATENT DOCUMENTS

| | | | | |
|---|---|---|---|---|
| 5,099,104 | A * | 3/1992 | Holzer et al. | 219/203 |
| 6,144,017 | A * | 11/2000 | Millett et al. | 219/522 |
| 7,246,470 | B2 * | 7/2007 | Beyrle | 52/171.1 |

FOREIGN PATENT DOCUMENTS

| | | |
|---|---|---|
| JP | 2000-277243 | 10/2000 |
| JP | 2002-134254 | 10/2002 |

* cited by examiner

CROSS-SECTIONAL VIEW IN B–B DIRECTION

METHOD OF MANUFACTURING HEAT-GENERATING PANEL, HEAT-GENERATING PANEL MANUFACTURED BY THE SAME, PANEL-SHAPED STRUCTURE, AND HEAT-GENERATING SYSTEM

TECHNICAL FIELD

The present invention relates to a method of manufacturing a heat-generating panel having a structure in which an electrically-conductive thin layer is formed on at least one surface of the panel and heat is generated by supplying electricity to the electrically-conductive thin layer, a heat-generating panel manufactured by the same, a panel-shaped structure, and a heat-generating system, and particularly to a method of manufacturing a heat-generating panel suitable for efficient formation of an electrode on the electrically-conductive thin layer, a heat-generating panel manufactured by the same, a panel-shaped structure, and a heat-generating system.

BACKGROUND ART

With respect to a window installed in a residence with good airtightness such as in a collective housing like a condominium, there has been a problem of condensation collecting on the inside of the window especially on winter mornings, for example. The condensation can be effectively prevented by installing double-glazed windows providing a thermal insulation layer between two plate glasses.

Furthermore, so as to prevent a phenomenon called "cold draft", that is, a flow of cold air onto a room floor of air cooled adjacent an inside surface of a glass in a cold season, a heat-generating glass has been increasingly employed, in which an electrically-conductive thin layer is formed on the plate glass to cause the electrically-conductive thin layer to generate heat. This type of the heat-generating glass is known, for example, as disclosed in Japanese Patent Application Laid-open Publication No. 2000-277243.

In the above document, a structure is described in which an electrically-conductive heat-generating layer on a surface of a translucent panel such as a plate glass and a pair of electrodes are provided by applying electrically-conductive paste to cover metal tape adhered to the heat-generating layer along opposing sides of the plate glass. To the electrodes elongated along the respective sides are connected lead wires for electrically connecting the electrodes with an external power supply.

For example, the electrically-conductive paste may be silver paste that is cured by heating through supplying hot air after application or being exposed to a far-infrared ray lamp to form the electrodes, each integrally including the metal tape. However, the above conventional curing method has problems in that time for curing is inevitably extended because the entire electrically-conductive paste as applied cannot be uniformly heated to be cured, which results in increase in energy loss. Thus, improvement of the conventional curing method has been desired in light of energy saving and reduction of manufacturing cost.

Further, in a collective housing such as a condominium, a number of heat-generating glass windows each having a heat-generating layer are often installed. In this case, when the heat-generating glasses are supplied with electric power at the same time, a problem sometimes occurs in that a large rush of electric current flows from a power supply to the heat-generating layer of each of the heat-generating windows and an overcurrent breaker operates to stop power supply at a peak of the rush current, causing significant downtime before power recovery. Moreover, there has been another problem in that the volume of wiring required for supplying electric power to a large number of heat-generating windows installed in each home from a power supply is increasing following expansion of the size of the housing where the heat-generating windows are installed, with a concomitant increase in the wiring cost and the cost for maintenance of the installed wiring.

DISCLOSURE OF THE INVENTION

The present invention has been made to overcome the above and other technical problems. One object of the present invention is to provide a method of manufacturing a heat-generating panel, a heat-generating panel, and a panel-shaped structure manufactured by the method.

Another object of the present invention is to provide a configuration enabling prevention of a problem of the rush current upon power-on with respect to the heat-generating system including a plurality of panel-shaped structures each configured with the heat-generating panels manufactured by the above method.

Yet another object of the present invention is to reduce a volume of wiring required in the heat-generating system each having a large number of panel-shaped structures using the heat-generating panel each manufactured by the above method.

Objects of the present invention other than the above as well as its configuration will become apparent according to the description of the present specification with the appended drawings.

An aspect of the present invention is a method of manufacturing a heat-generating panel having a configuration in that an electrically-conductive thin layer is provided on at least one surface of a translucent plate and the electrically-conductive thin layer is caused to generate heat by supplying electric power to the same, characterized by:

fixing a metal strip onto the electrically-conductive thin layer formed on the plate along each of opposing sides of the plate;

applying an electrically-conductive paste over each of the metal strips to cover the same;

contacting a heat-generating portion of the heating device at edges forming the two sides of the plate where the metal strip is fixed in a state in which a temperature of the heat-generating portion is above a predetermined temperature, the heat-generating portion being longer than at least a full length of the metal strip, and curing the electrically-conductive paste to form electrodes having the metal strip and the electrically-conductive paste; and connecting a conductor wire electrically to each of the electrodes.

Another aspect of the present invention is heat-generating panel manufactured by the manufacturing method according to the above.

In the method of manufacturing the heat-generating panel, the heat-generating portion of the heating device may have a heat-generating part of a flexible thin plate shape so as to closely contact to the edge of the plate and an elastic member supporting the heat-generating part so that the heat-generating part is pressed against the edge of the plate.

Yet another aspect of the present invention is a double-layered panel-shaped structure characterized by comprising:

a first plate being the heat-generating panel according to the above;

a second, translucent plate disposed opposite the first plate and facing the electrically-conductive thin layer thereof;

a spacer disposed between the first plate and the second plate along each of the electrode provided to the first plate at an inward part of the electrode; and a sealant disposed to cover the electrode in a void formed at outer side part of the first plate by the first plate, the second plate, and the spacer interposed therebetween.

A further aspect of the present invention is a panel-shaped structure having a laminated structure, characterized by comprising:

a first plate being the heat-generating panel according to the above;

a second, translucent plate disposed opposite the first plate and facing the electrically-conductive thin layer thereof; and an interlayer film interposed between the first plate and the second plate.

Yet another aspect of the present invention is a heat-generating system including the heat-generating panel manufactured by the manufacturing method according to claim 1, characterized by comprising:

a plurality of heat-generating panel-shaped structures each configured to have the heat-generating panel;

a power supply device converting an input current from another power supply into an on-off current and outputting the current as converted as an output current, wherein an output of the power supply device is connected to each conductor wire of the plurality of the heat-generating panel-shaped structures, and when the power supply device is turned on, an output current from the power supply device is supplied to the respective heat-generating panel-shaped structures with a time delay.

It is possible that the plurality of the heat-generating panel-shaped structures consist of a first heat-generating panel-shaped structure to a Nth heat-generating panel-shaped structure, N being an integer not less than 2, and, when the power supply device is turned on, an output current from the power supply device is initially supplied to the first heat-generating panel-shaped structure, and then supplied to the subsequent structures up to the Nth heat-generating panel-shaped structure in a cascade manner.

The on-off current as the output current from the power supply device may be configured to have a variable duty ratio with respect to an on-off cycle thereof.

A further aspect of the present invention is a heat-generating system including the heat-generating panel manufactured by the manufacturing method above, characterized by comprising:

a plurality of heat-generating panel-shaped structures each configured to have the heat-generating panel;

a power supply device converting an input current from another power supply into an on-off current and outputting the current as converted as an output current; and at least one heat-generating panel-shaped structure group, each configured with a plurality of heat-generating panel-shaped structure, respective distances between the opposing electrodes thereof being substantially equal to each other, an output of the power supply device being connected to the respective heat-generating panel-shaped structures configuring the heat-generating panel-shaped structure group.

The operation and/or effect other than the above will become apparent with reference to the description in the present specification with the appended drawings.

REFERENCE SIGNS

Figure 1A:
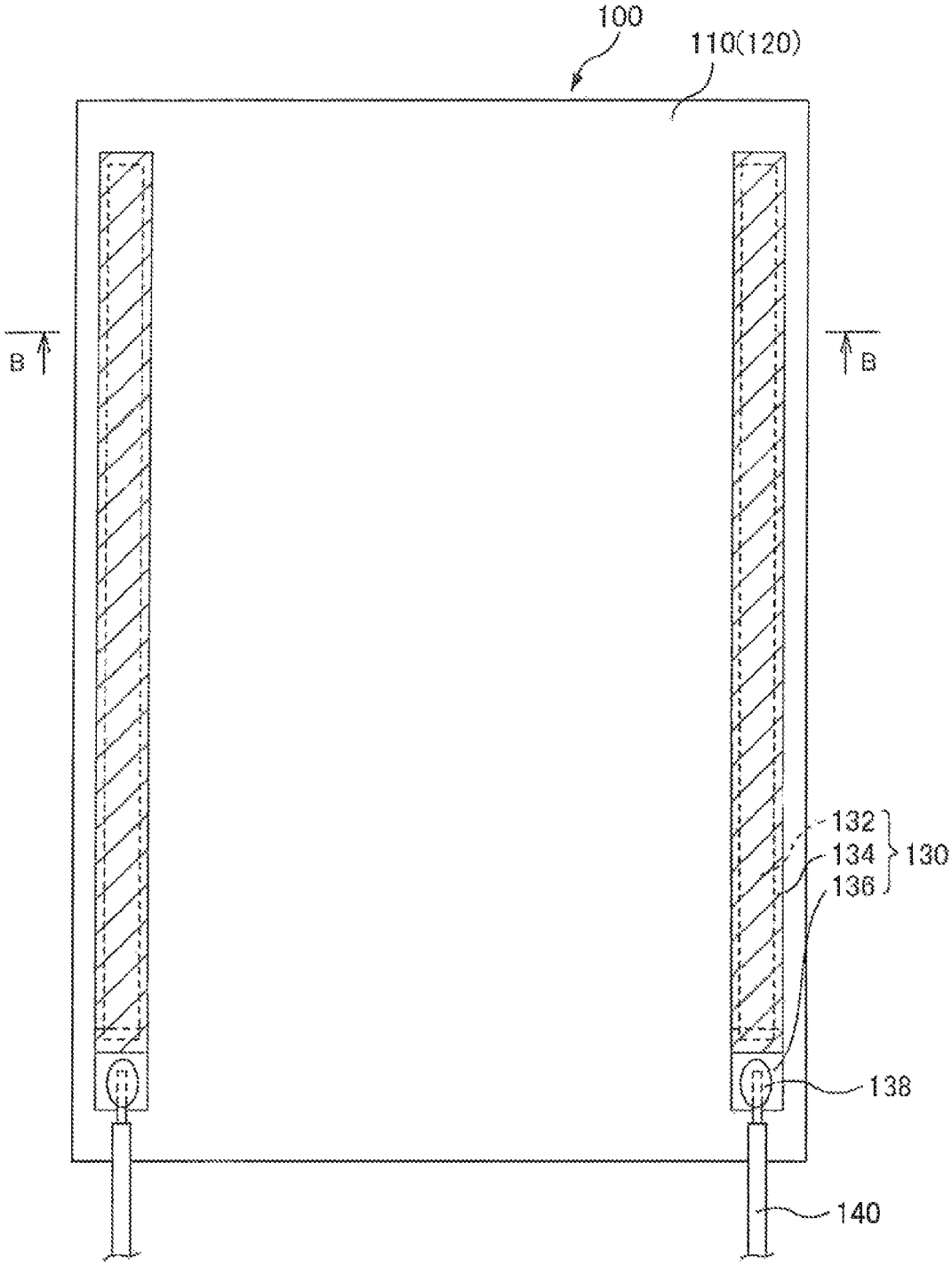
FIG. 1A is a plan view of a heat-generating panel according to an embodiment of the present invention.

100, 100-1, 100-2, 100-3, . . . , **100-*n*** . . . . Heat-generating panel
110 . . . . Plate glass (Translucent panel)
120 . . . . Electrically-conductive thin layer
130 . . . . Electrode
132 . . . . Metal tape (metal strip)
134 . . . . Silver paste (Electrically-conductive paste)
136 . . . . Copper foil tape
138 . . . . Solder
140 . . . . Lead wire (Conductor wire)
200 . . . . Heater (Heating device)
210 . . . . Base
220 . . . . Heater portion (Heat-generating portion)
**220*a*** . . . . Heater element
230 . . . . Elastic member
300 . . . Double-glazed glass (Double-layered panel-shaped structure)
310 . . . . Spacer (spacer)
320 . . . . Primary sealant
330 . . . . Secondary sealant
400 . . . . Laminated glass (Laminated panel-shaped structure)
410 . . . . Interlayer film HGS . . . . Heat-generating system
PS . . . . Power supply
REC . . . AC/DC converter
SW1, SW2, SW3, . . . , SWn . . . . Switching circuit
VR1, VR2, VR3, . . . , VRn . . . . Variable voltage circuit
SLC . . . . Signal level conversion circuit
CC . . . . Cascade circuit
G1, G2 . . . . Heat-generating panel-shaped structure group

DETAILED DESCRIPTION OF THE INVENTION

Preferred embodiments of the present invention will be described hereinbelow referring to the accompanying drawings.

Figure 1B:
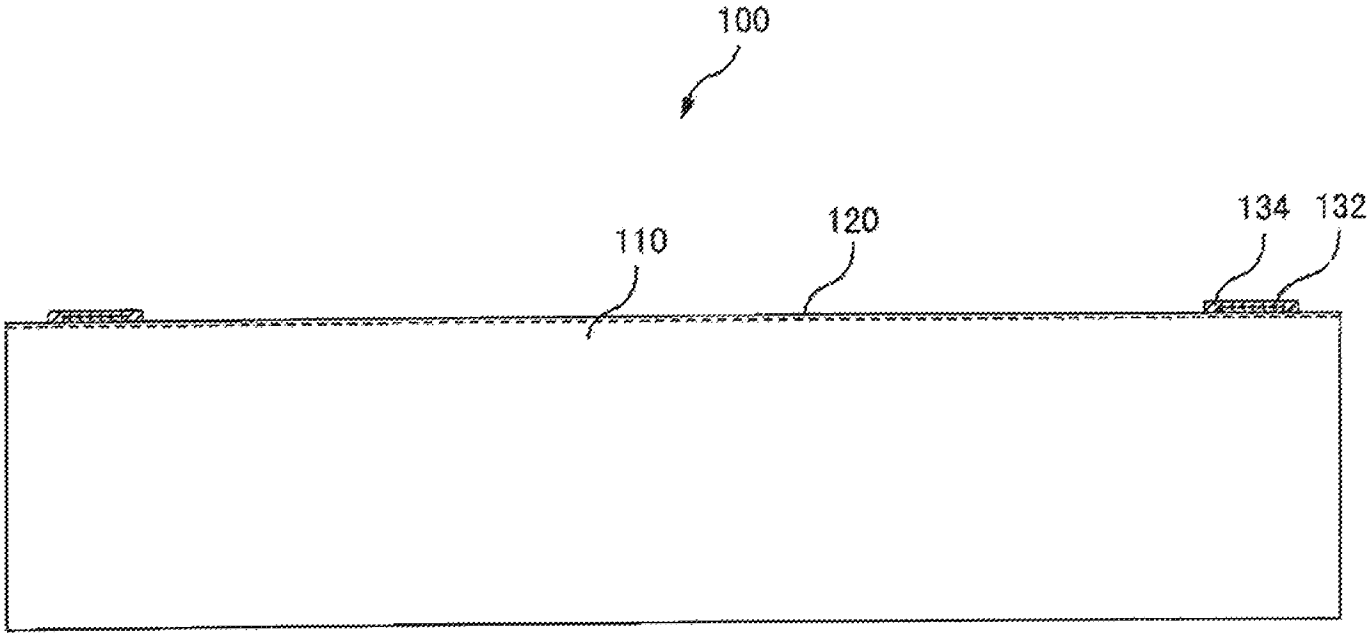
FIG. 1B is a cross-sectional view of the heat-generating panel in FIG. 1.

FIG. 1A is a plan view of a heat-generating panel according to an embodiment of the present invention. FIG. 1B is a cross-sectional view of the heat-generating panel in FIG. 1A.

According to the present embodiment, a heat-generating panel 100 is formed by providing an electrically-conductive thin layer 120 on a surface of a plate glass 110 as a translucent panel being a base and providing an electrode 130 for supplying electric power to the thin layer 120. As the electrically-conductive thin layer 120 is supplied with electric power through the electrode 130 from a power supply which is not shown, the electrically-conductive thin layer 120 generates heat while working as a heat-generating layer and warms the surface of the heat-generating panel 100. According to this, condensation on the surface of the plate 100 can be prevented.

The plate glass 110 of the present embodiment is a rectangular plate glass which may be formed with an ordinary translucent float glass, a wire-reinforced glass, a colored glass and the like. The planar shape of the plate glass 110 is not necessarily a rectangle, but may be any shape such as a shape with curved profile. The plate glass 110 may be one like a decorated glass decorated by etching on its surface. In particular, it is preferable to use a Low-E glass as the plate glass 110 for further improvement in heat insulating performance.

The electrically-conductive thin layer 120 may be, for example, a metal thin layer including one or more material selected from the group consisting of gold, silver, copper, palladium, tin, aluminum, titanium, stainless steel, nickel, cobalt, chrome, iron, magnesium, zirconium, gallium, and so on, a thin layer of metal oxide with carbon, oxygen or the like of such materials, or a metal oxide thin layer such that polycrystal base thin layer is formed with ZnO (zinc oxide), ITO (tin-doped indium oxide), $In_2O_3$ (indium oxide), $Y_2O_3$ (yttrium oxide), or the like.

In the present embodiment, the electrically-conductive thin layer 120 is formed over substantially the entire surface of the plate glass 110. However, depending on the purpose and the like of the heat-generating panel 100, it is possible to form the electrically-conductive thin layer 120 on only a part of the surface.

To the plate glass 110 is provided with a pair of electrodes 130 on the surface where the electrically-conductive thin layer 120 is formed. In the present embodiment, the strip-shaped electrodes 130 are respectively provided along the inner sides of one opposing pair of edges of two pairs of opposing sides of the rectangular plate glass 110. A lead wire (conductor wire) 140 is connected to each of the electrodes 130 for supplying electric power thereto.

Figure 2A:
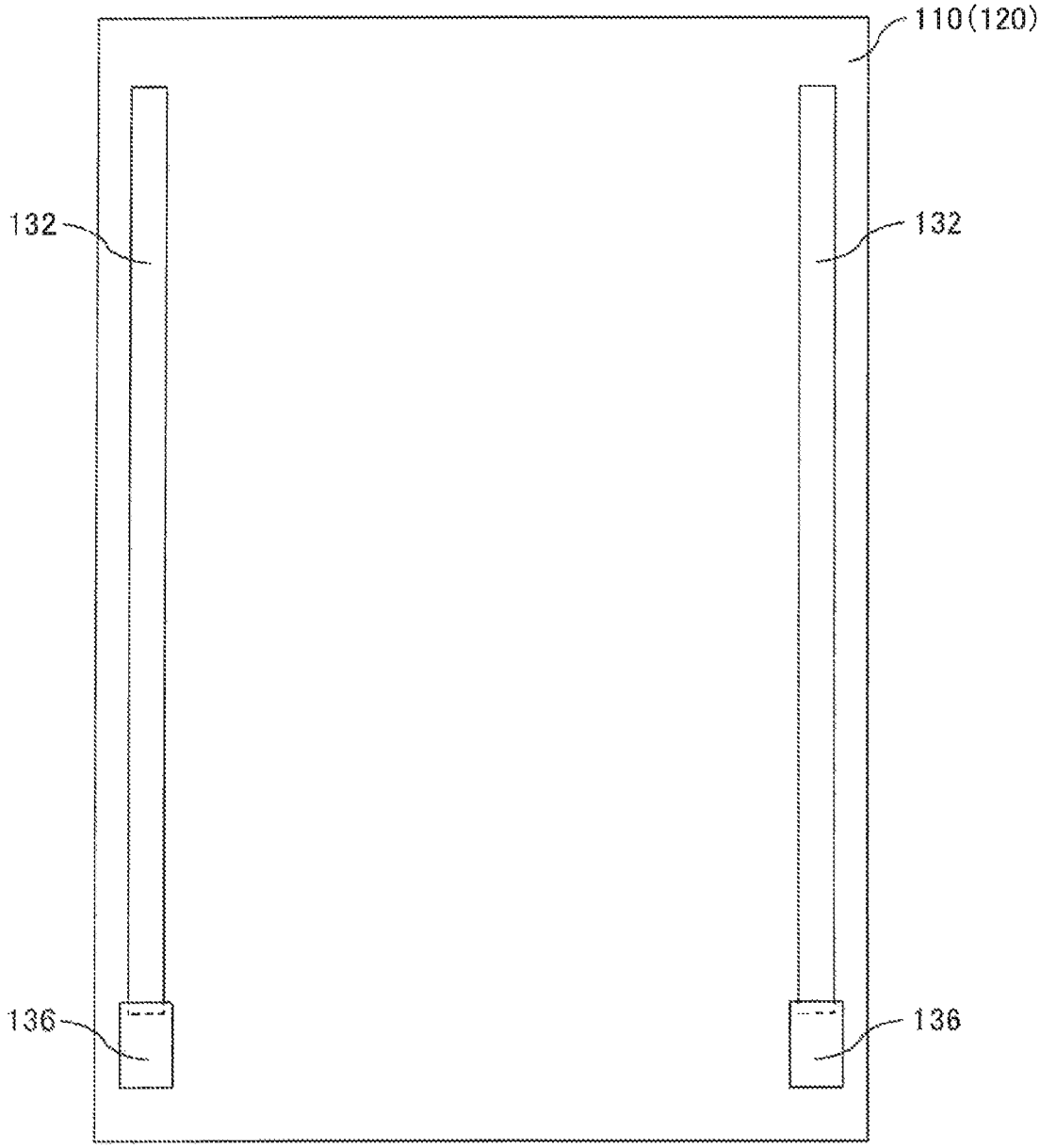
FIG. 2A is a diagram illustrating a manufacturing process of the heat-generating panel in FIG. 1.
Figure 2B:
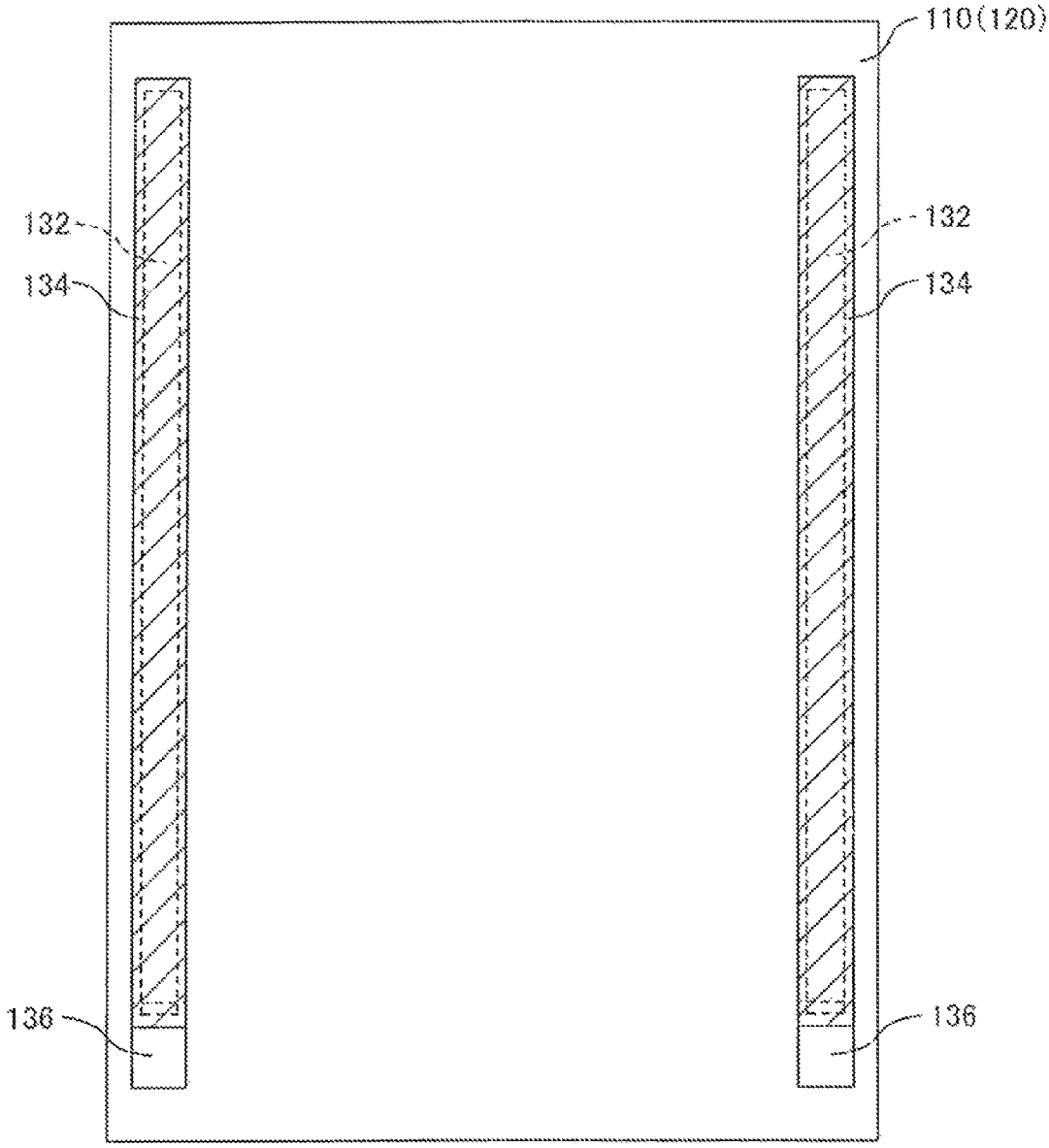
FIG. 2B is a diagram illustrating a manufacturing process of the heat-generating panel in FIG. 1.
Figure 2C:
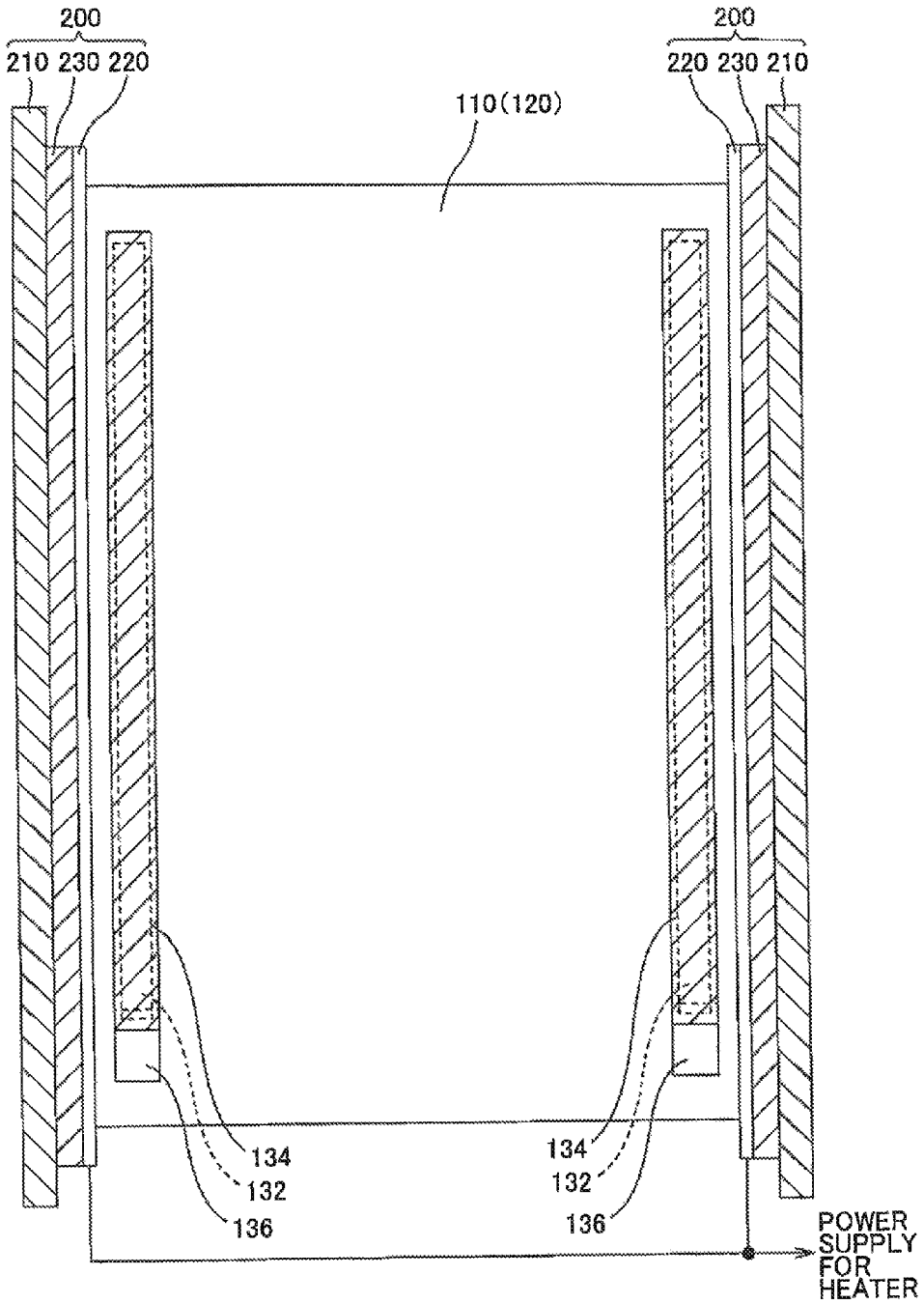
FIG. 2C is a diagram illustrating a manufacturing process of the heat-generating panel in FIG. 1.

A method of forming the electrode 130 is described hereinbelow. FIGS. 2A-2C are drawings showing manufacturing processes of the heat-generating panel. In particular, the drawings show the processes of forming the electrodes 130 on the plate glass 110 on which the electrically-conductive thin layer 120 is already formed.

First, as shown in FIG. 2A, so as to reduce as much as possible an electric resistance between the electrode 130 and the electrically-conductive thin layer 120 contacting thereto, a metal tape (metal strip) 132 of an appropriate width is adhered to the plate 110 along each of the opposing edges of the plate 110. As the metal tape 132, a copper foil tape or a nickel tape of a specific resistance value of $1\text{-}3\times10^{-6}$ ohms·cm is preferably used. At an end of the metal tape 132, a copper foil tape 136 is adhered to establish electric connection as a part of the copper foil tape 136 is laid over the metal tape 132. The copper foil tape 136 works as a terminal to which the lead wire 140 is connected as shown in FIG. 1A.

Then, as shown in FIG. 2B, except for a part of the copper foil tape 136, silver paste 134 as electrically-conductive paste is applied to the entirety of the metal tape 132 so as to cover the same. As the silver paste 134, a paste can be used in which silver powder is dispersed with a resin binder and a solvent to show a specific resistance value of, for example, $5\text{-}7\times10^{-5}$ ohms·cm.

At this stage, a heating process is carried out to cure the silver paste 134 as applied. An overview of the process is illustrated in FIG. 2C. FIG. 2C is a plan view schematically illustrating the situation where a heater 200 as a heating device is contacted to each edge of the plate glass 110 along which the electrode 130 is provided. Each heater 200 is a device with an elongated shape, placed along each edge of the plate glass 110 where the electrode 130 is provided over a substantially entire length of the edge. The heater 200 has a base 210 which is an elongated plate-shaped member of a required rigidity and a heater portion (heat-generating portion) 220 attached to a surface of the base 210 with an elastic member 230.

Figure 3:
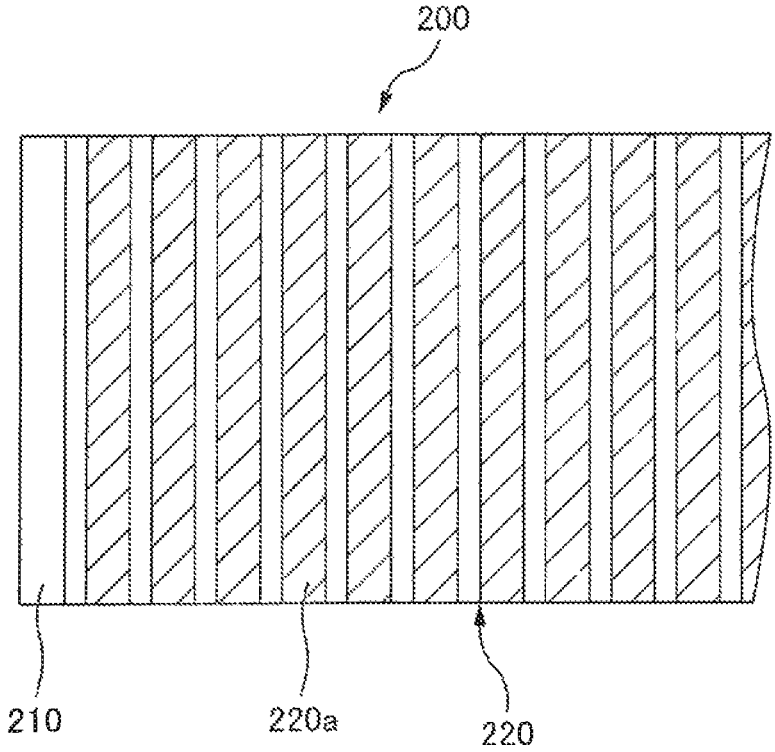
FIG. 3 is a schematic diagram illustrating a heater portion of the heater used for the manufacturing process of the heat-generating panel in FIG. 1.

FIG. 3 is a front view illustrating the heater 200 seen from the heater portion 220 side. As shown in the present embodiment, the heater portion 220 can be configured by, for example, arranging a number of heater elements 220*a* connected in parallel. For example, a device usually called a film heater in which the heater element 220*a* is formed as a comb-like heat-generating pattern of a copper foil on a flexible resin film is preferably used. A heater of any type/configuration may be used as long as it has a shape and dimensions such that it is placed over a substantially entire length of the edge of the plate glass 110 and has the necessary heating capacity. A height and width of the heater portion 220 as required may be greater than or equal to a thickness and a length of the edge of the plate glass 110 to be heated by the heater 200, respectively.

The heater portion 220 configured to have flexibility is attached to the base 210 with the elastic member 230. The elastic member 230 may be a sponge-like resin mat with thermal resistance against heat generation by the heater portion 220, or of a configuration in which a number of resilient elements such as a spring are provided. The reason why the heater portion 220 is provided with flexibility by the elastic member 230 is that when the heater portion 220 is pressed onto the edge of the plate glass 110 a uniform pressing force is generated and heat transfer from the heater portion 220 to the plate glass 110 can be made uniform. Further, the elastic member 230 works as a thermal insulator to prevent heat by the heater portion 220 from dissipating to the base 210 to further reduce loss of energy. Further effect can be obtained that the heater portion 220 can be fit to the edge of the plate glass 110 with a non-linear profile to an extent without exchanging the base 210.

As described above, the silver paste 134 as applied is conventionally heated and cured by hot air or far-infrared light. In this embodiment, as described referring to FIG. 2C, the heater portion 220 of the heater 200 is pressed against the edge of the plate glass 110 where the electrode 130 is provided with an appropriate force and the heater element 220*a* of the heater portion 220 is heated by supplying electric power thereto from the power supply (not shown) for the heater 200. According to this process, the silver paste 134 of the electrode 130 is heated to have a uniform temperature of 110-150° C. and the entirety of the silver paste 134 as applied can be uniformly cured. This is made possible by the fact that a thermal conductivity of the plate glass 110 is small and the process is suitable for heating a portion 10-plus mm wide from the edge where the electrode 130 is provided.

When the curing of the silver paste 134 has been completed according to the above process, the lead wire 140 is connected to the copper foil tape 136 at the end of the electrode 130 with solder 138 to finish manufacture of the heat-generating panel 100 as shown in FIG. 1A.

According to the above configuration, the entirety of the silver paste 134 can be uniformly heated when the electrode 130 is formed, and an efficient heating process is realized with less energy loss for heating.

Figure 4A:
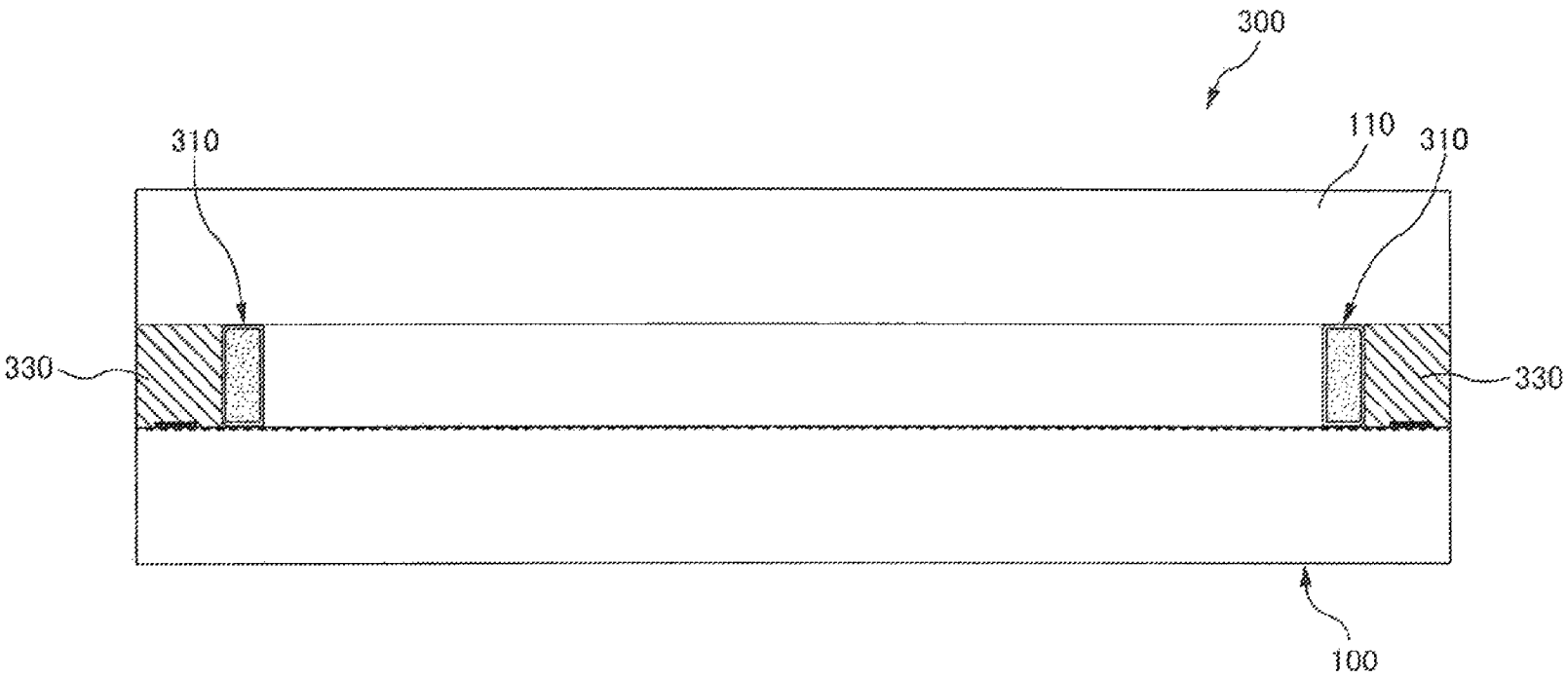
FIG. 4A is a cross-sectional view of a double-glazed glass configured with the heat-generating panel in FIG. 1.
Figure 4B:
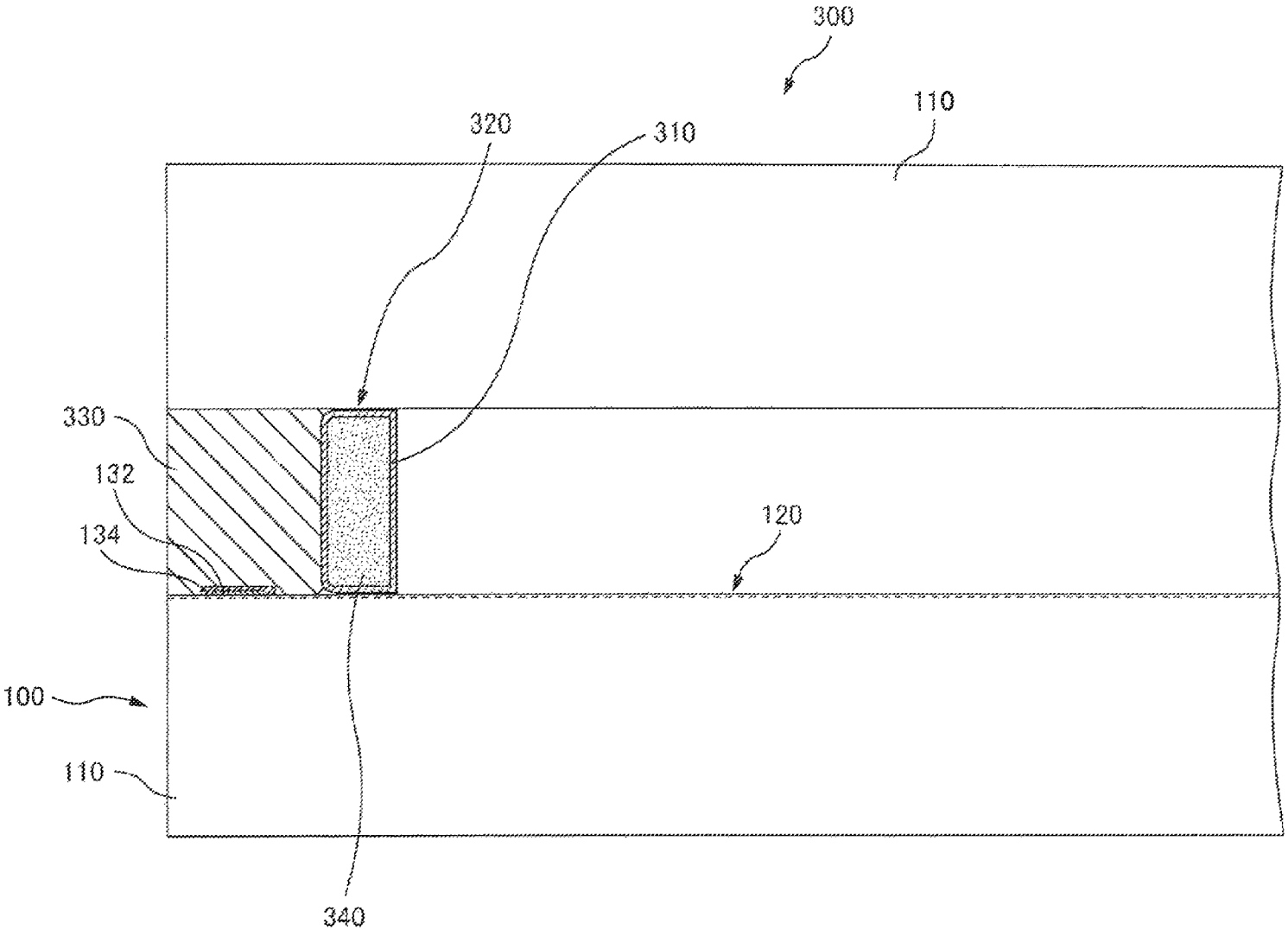
FIG. 4B is a partially-enlarged cross-sectional view of the double-glazed glass in FIG. 4A.

Next, the panel-shaped structure constructed with the heat-generating panel 100 as manufactured above will be described. FIG. 4A is a cross-sectional view of a double-glazed glass configured with the heat-generating panel in FIG. 1. FIG. 4B is a partially-enlarged cross-sectional view of the double-glazed glass in FIG. 4A.

In a double-glazed glass 300 as the double-layered panel-shaped structure of the present embodiment, the heat-generating panel 100 and another plate glass 110 are positioned as opposed with a distance using spacers 310 so that the electrically-conductive thin layer 120 of the heat-generating panel 100 is positioned inside to provide a space between both plate glasses 110. The space is to be a dried air layer. The spacers 310 are placed, for example, adjacent the electrode 130 at the inner side thereof in parallel, and a space formed with both plate glasses 110 and the respective sides of the spacers 310 is sealed with a secondary sealant 330 with the electrode 130. A contacting surface between the spacer 310 and the respective plate glasses 110 is sealed with a primary sealant 320. The spacers 310 are of course placed along the respective edges where the electrodes 130 are not provided.

As the spacer 310, an aluminum member is preferable in that it is lightweight and can have the required strength, for example. A desiccant 340 is contained in a void inside the spacer 310 to protect the dried air layer from humidity. For the primary sealant 320, for example, an insulating butyl sealant is preferably used so as to electrically insulate the spacer 310 from the electrically-conductive thin layer 120. For the primary sealant 320 provided between the spacer 310 and the plate glass 110 without the electrically-conductive thin layer 120, an ordinary butyl sealant may be used.

Figure 5:
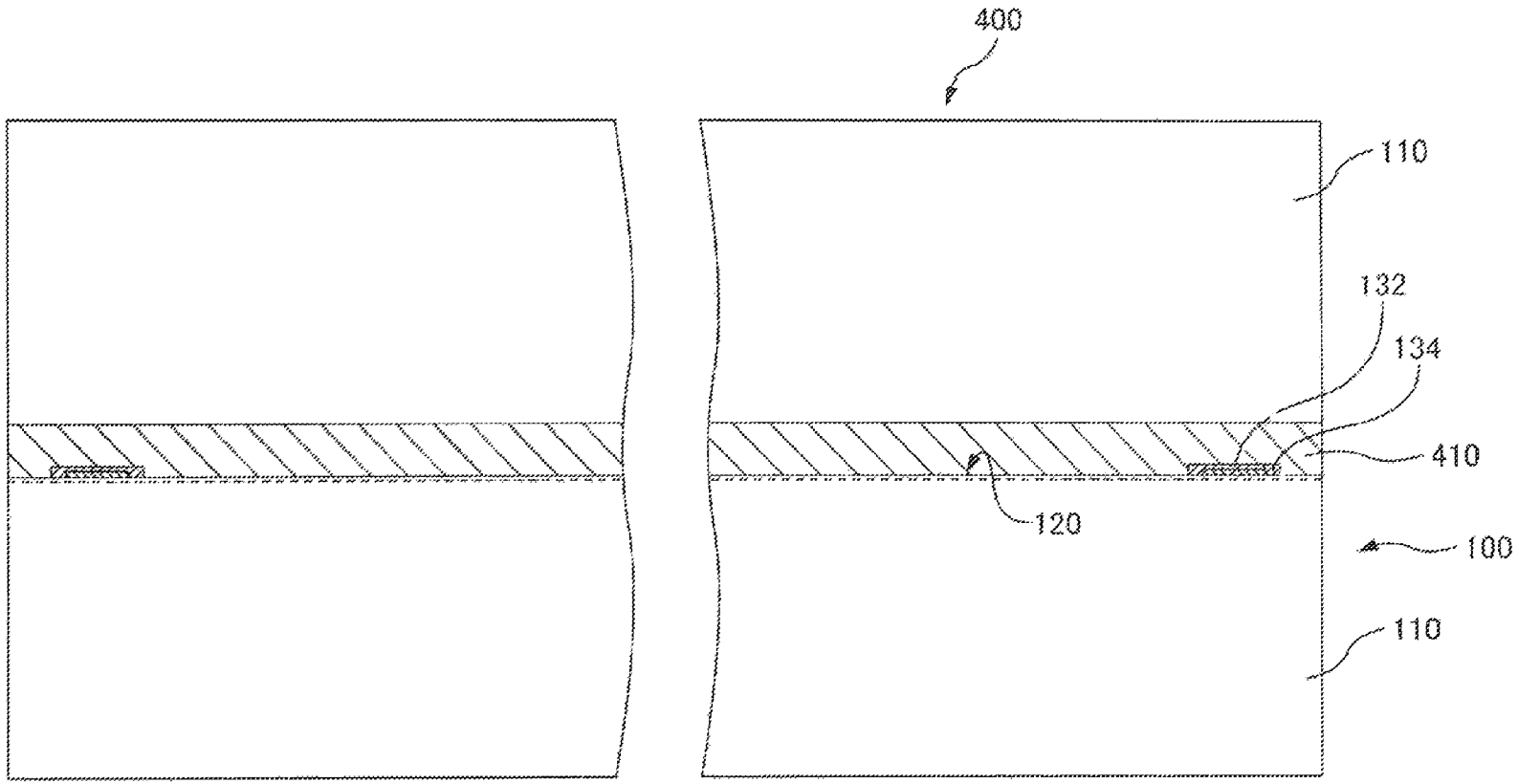
FIG. 5 is a cross-sectional view of a laminated glass configured with the heat-generating panel in FIG. 1.

Next, a laminated panel-shaped structure constructed with the above heat-generating panels 100 will be described. FIG. 5 is a cross-sectional view of a laminated glass configured with the heat-generating panel in FIG. 1.

The laminated glass 400 as a laminated panel-shaped structure of the present embodiment is formed by intimately contacting the above heat-generating panel 100 and the other plate glass 110 so that the electrically-conductive thin layer 120 of the heat-generating panel 100 is placed inside with an interlayer film 410 therebetween. The interlayer film 410 is formed, for example, with a resin material such as ethylene vinyl acetate (EVA) and polyvinyl butyral (PVB).

Figure 6:
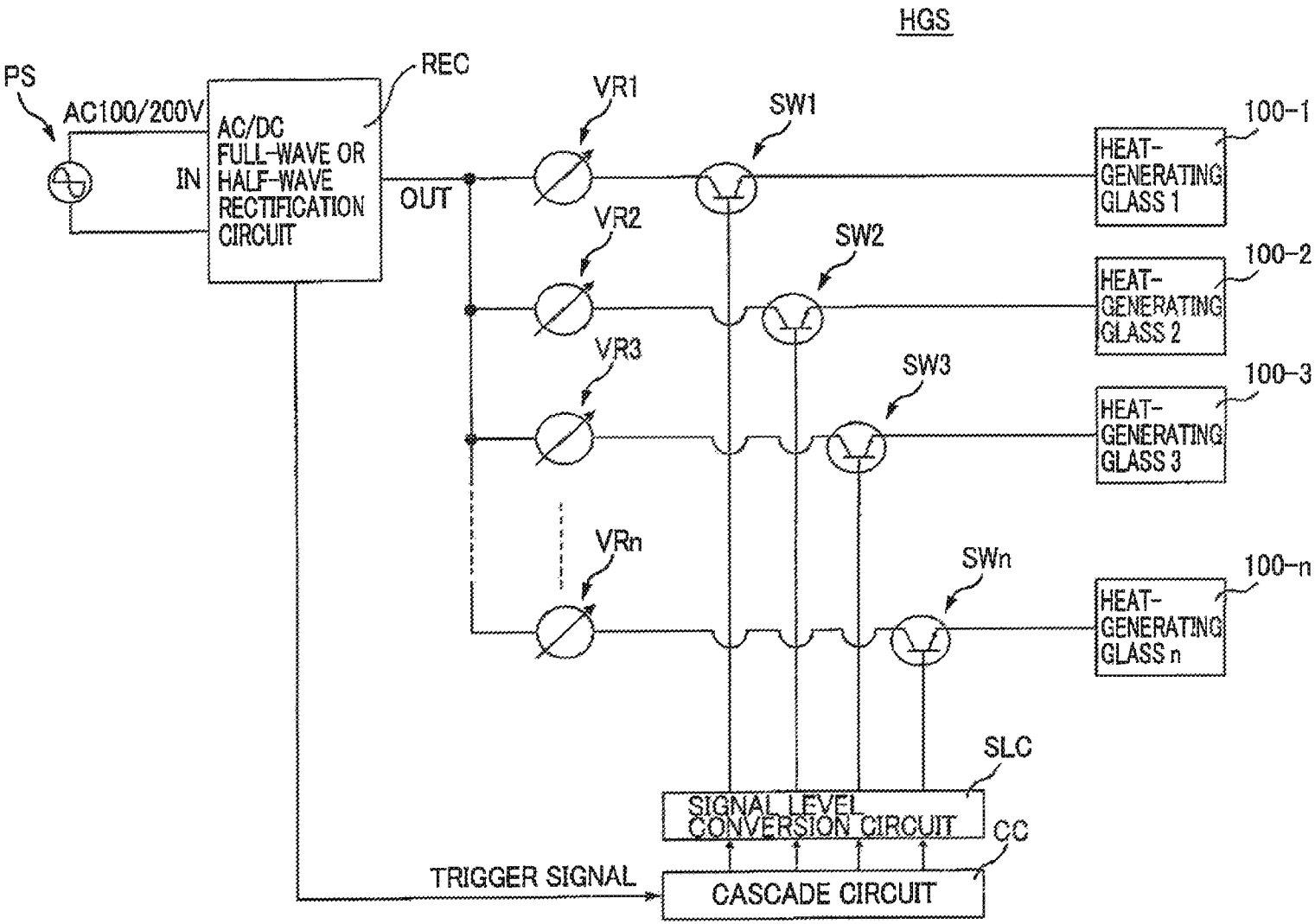
FIG. 6 is a block diagram illustrating a power supply circuit of a heat-generating system according to an embodiment of the present invention.

Next, a heat-generating system (HGS) according to another aspect of the present invention will be described according to an embodiment thereof. FIG. 6 is a block diagram illustrating a power supply circuit of a heat-generating system according to an embodiment of the present invention. The heat-generating system is configured to include a number of the double-glazed glasses 300 and/or the laminated glasses 400, each formed with the heat-generating panel 100 manufactured according to the above-mentioned manufacturing method, hereinafter referred to as "heat-generating glass" for simplicity, that are installed in a large-scale collective housing such as a condominium. In the attached drawings and the description hereinbelow, the glasses including the double-glazed glass 300 and the laminated glass 400 are to be collectively called "heat-generating glasses 100."

An AC current from a power supply PS in a distribution panel at each home is subject to full-wave or half-wave rectification by an AC/DC converter REC. The power supply PS usually outputs AC100V or AC200V, an effective voltage of which being AC50V or AC100V respectively, when subject to half-wave rectification by the converter REC.

An output of the converter REC is branched into the heat-generating glasses 100-1 to 100-*n*, and variable voltage circuits VR1-VRn are inserted in the respective branch lines. The purpose of inserting the variable voltage circuits VR1-VRn is to regulate the electric power to be supplied to each heat-generating glass 100, so that, when there are differences in the areas of the heat-generating glasses 100-1 to 100-*n* connected to the respective output branch lines of the converter REC, a uniform temperature rise can be obtained for each heat-generating glass 100. More specifically, if an area of the heat-generating glass 100-2 is smaller than the area of the heat-generating glass 100-1, the variable voltage circuit VR2 functions to make power supplied to the heat-generating glass 100-2 smaller than that to the heat-generating glass 100-1.

A variety of known voltage regulating methods may be applied to the variable voltage circuits VR1-VRn, such as a method of reducing an effective voltage by clamping a maximum voltage of an output from the converter REC, a method of regulating the effective voltage by varying an on-off duty ratio of an output current from the converter REC at each cycle by switching of a chopper circuit, or the like. A regulation parameter for each variable voltage circuit VRn can be preset according to the area of each heat-generating glass 100-1 to 100-*n*. Alternatively, it is possible to employ a configuration in which a regulation circuit, which is not shown, is provided to enable regulation of the parameters circuit by circuit or collectively.

At the downstream parts with respect to the respective variable voltage circuits VR1-VRn, switching circuits SW1-SWn are provided. The purpose of providing the switching circuits SW1-SWn is to supply electric power to the respective heat-generating glasses 100-1 to 100-*n* in sequence with a predetermined time delay when the converter REC has been turned on and to prevent an excessive rush current from flowing into the heat-generating glasses 100 from the converter REC.

For this configuration, each switching circuit SW1-SWn is equipped with switching elements such as transistors, power MOS-FETs, thyristors, triacs, and the like. Further, a cascade circuit CC and a signal level conversion circuit SLC are provided as a drive circuit of the respective switching devices.

As described later, the cascade circuit CC is a circuit that outputs turn-on signals sequentially with a time delay to the switching devices in the respective switching circuits SW1-SWn. The signal level conversion circuit SLC is an interface circuit that converts a signal level of an output signal from the cascade circuit CC into that for driving each switching device. The signal level conversion circuit SLC can be omitted if the configuration of the switching circuit SW or the like permits. In the present embodiment, a trigger signal is provided to the cascade circuit CC that is synchronized with a rising edge of the converter REC output and that triggers the cascade circuit CC to output a turn-on signal with a time delay.

Figure 7:
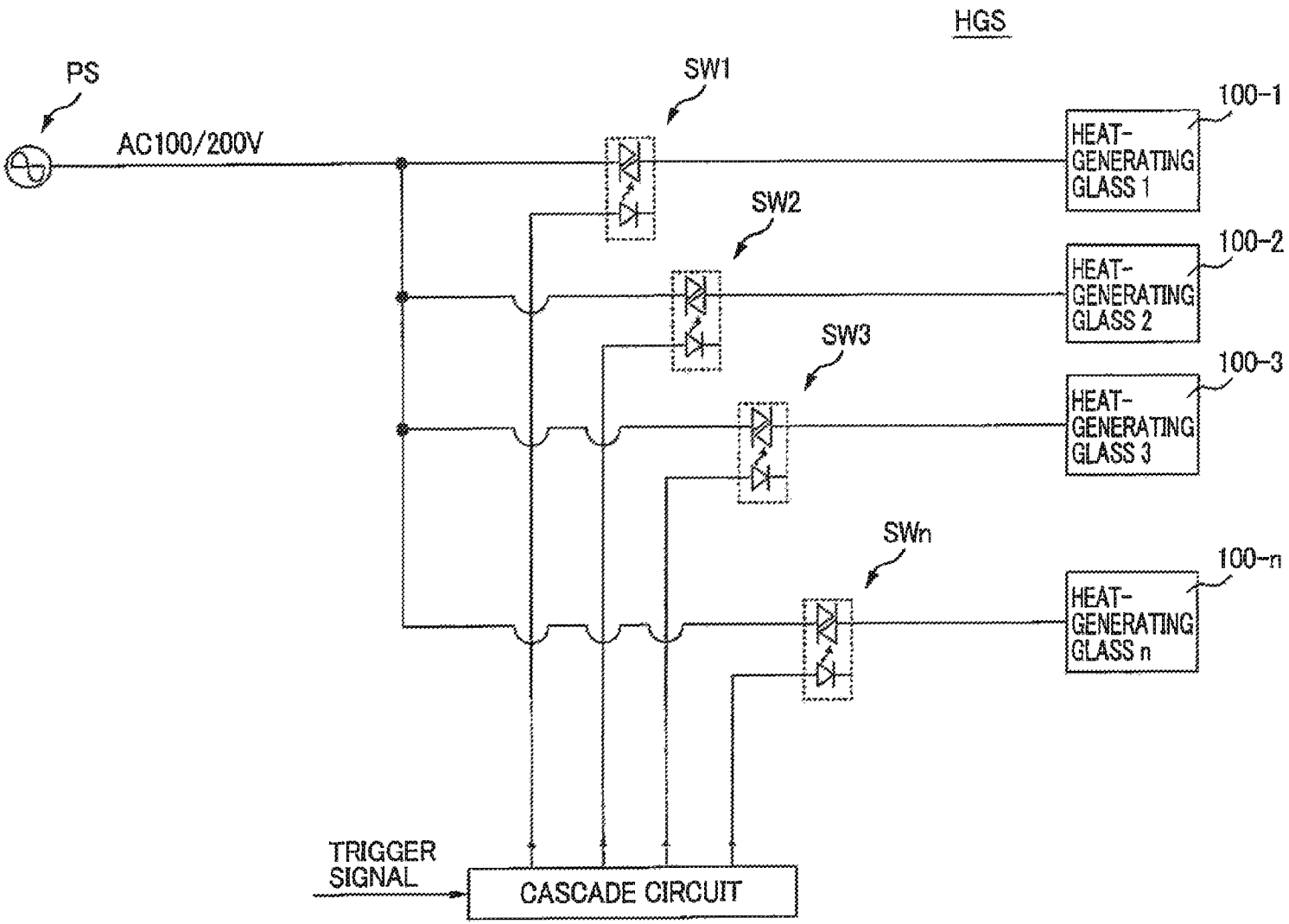
FIG. 7 is a block diagram illustrating a power supply circuit of a heat-generating system according to an embodiment of the present invention.

FIG. 7 is a block diagram illustrating a power supply circuit of a heat-generating system according to an embodiment of the present invention. The configuration in FIG. 7 is different from the circuit in FIG. 6 mainly in the construction of the switching device used in each switching circuit SW1-SWn. In this embodiment, each switching device is configured using a device called a photo-thyristor. The photo-thyristor receives an output signal from the cascade circuit CC and converts the signal as received into an optical signal to drive a gate of the thyristor. Since the gate control signal is insulated from the signal for actually driving the gate as described above, the signal level conversion circuit SLC is omitted from the output of the cascade circuit CC.

Further, since the photo-thyristor has a reverse blocking function, the circuit in FIG. 7 is not provided with the AC/DC converter REC which was in FIG. 6. Furthermore, since a time period for retaining the turn-on signal for the photo-thyristor, i.e., the gate control signal can be varied by the cascade circuit CC as will be described later, the variable voltage circuit VR is omitted in FIG. 7.

Figure 8A:
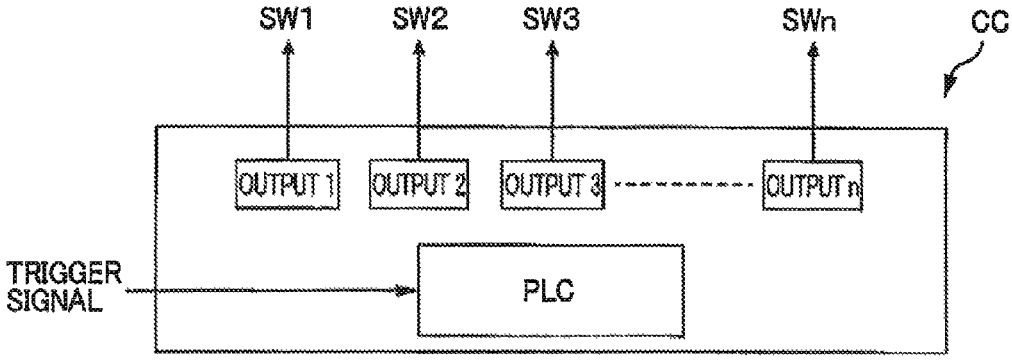
FIG. 8A is a block diagram illustrating an example of a cascade circuit.
Figure 8B:
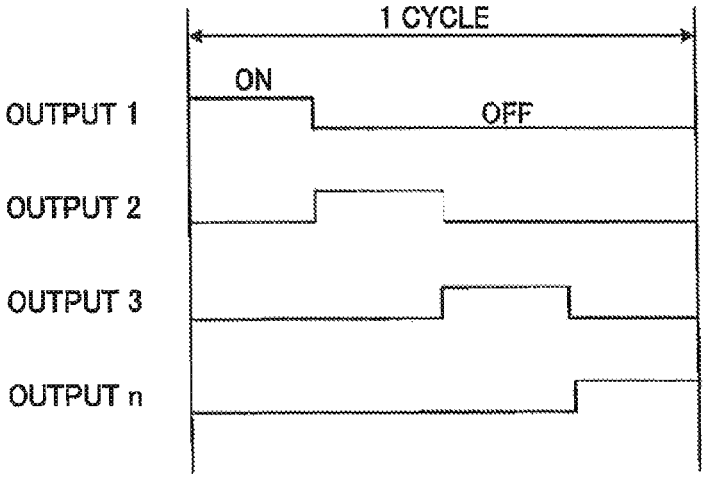
FIG. 8B is a diagram illustrating a time sequence of power-on by the cascade circuit in FIG. 8A.

Next, the configuration and the function of the cascade circuit CC are described. FIG. 8A is a block diagram illustrating an example of a cascade circuit. FIG. 8B is a diagram illustrating a time sequence of power-on by the cascade circuit in FIG. 8A. The cascade circuit CC of this embodiment has a programmable logic controller, or PLC, in which an output sequence of the turn-on signals to the respective switching circuits SW1-SWn is preliminarily programmed. According to an exemplary configuration of the cascade circuit CC, a trigger signal generated by starting of the converter REC is received and the turn-on signals are output according to the predetermined sequence illustrated in FIG. 8B.

Here, one cycle of operation of the cascade circuit CC in this embodiment is set at 200 ms. Therefore, in a case in which the PLC is configured to be able to vary an output time of the turn-on signal to each of the switching circuits SW1-SWn within the above cycle time, electric power to be supplied to the respective heat-generating glasses 100 can be regulated without using the above-mentioned variable voltage circuits VR1-VRn. In addition, instead of the PLC, a one-chip microcomputer may be used in which a CPU, a memory device, an I/O interface circuit, and so on are integrated on a single chip.

FIGS. 9A-11A show block diagrams illustrating other examples of the cascade circuit. FIGS. 9B-11B show diagrams illustrating a time sequence of power-on by the cascade circuits in FIGS. 9A-11A.

Figure 9A:
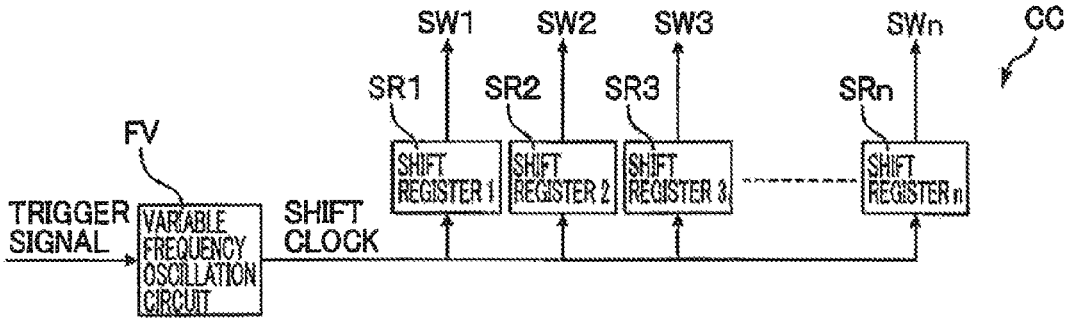
FIG. 9A is a block diagram illustrating an example of the cascade circuit.
Figure 9B:
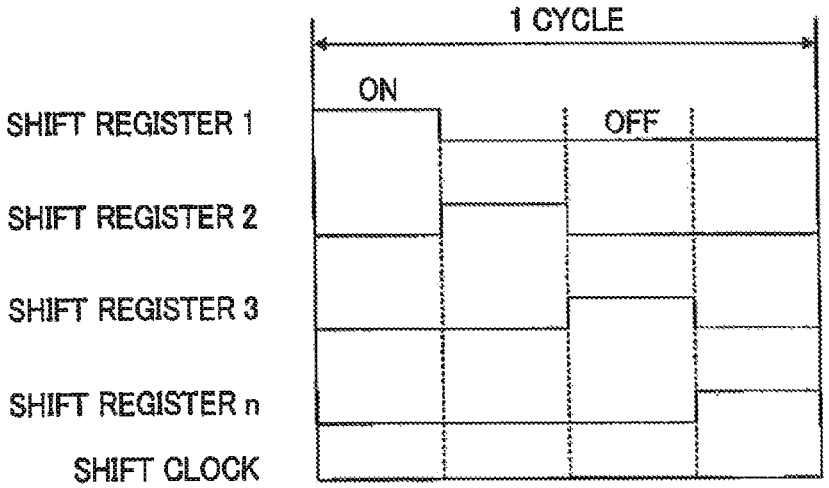
FIG. 9B is a diagram illustrating a time sequence of power-on by the cascade circuit in FIG. 9A.
Figure 10A:
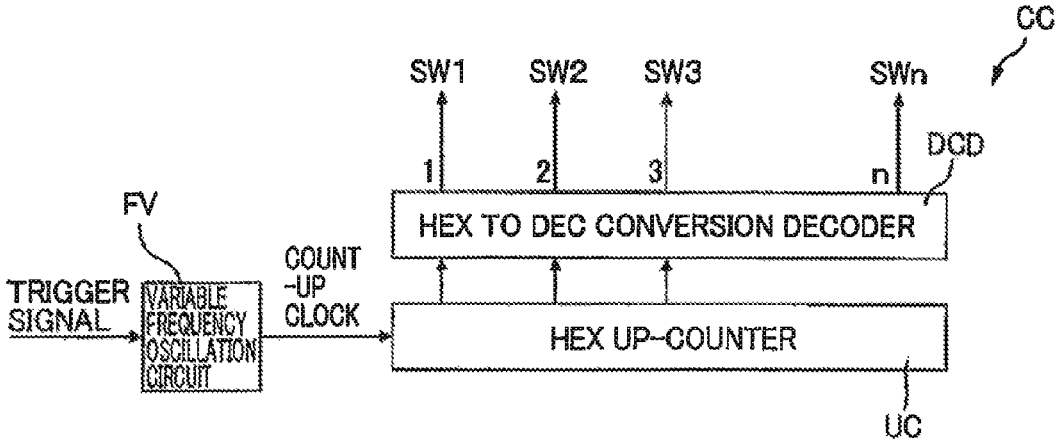
FIG. 10A is a block diagram illustrating an example of a cascade circuit.
Figure 10B:
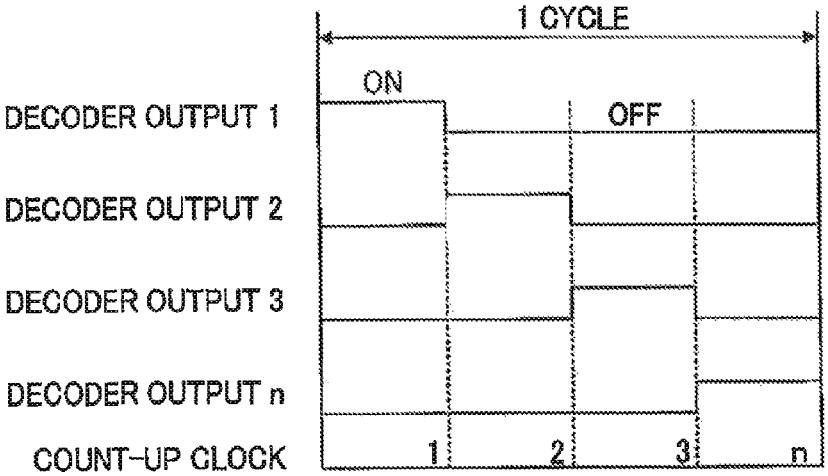
FIG. 10B is a diagram illustrating a time sequence of power-on by the cascade circuit in FIG. 10A.

In the circuits in FIG. 9A and FIG. 10A, a variable frequency oscillating circuit FV outputs a clock signal triggered by the trigger signal. The clock signal is input to shift registers SR1-SRn in FIG. 9A and to a hexadecimal-to-decimal converting decoder DCD via a hexadecimal up-counter UC in FIG. 10A. Then, a turn-on signal as delayed by the time period shown in FIG. 9B or 10B is output to the switching circuits SW1-SWn.

Figure 11A:
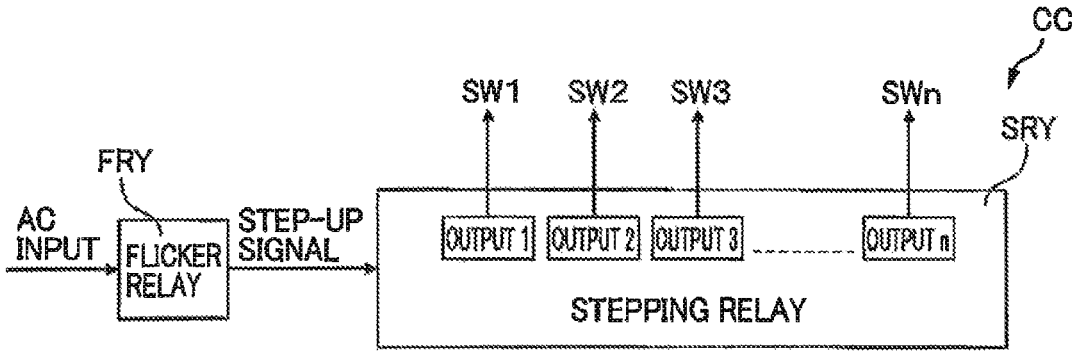
FIG. 11A is a block diagram illustrating an example of a cascade circuit.
Figure 11B:
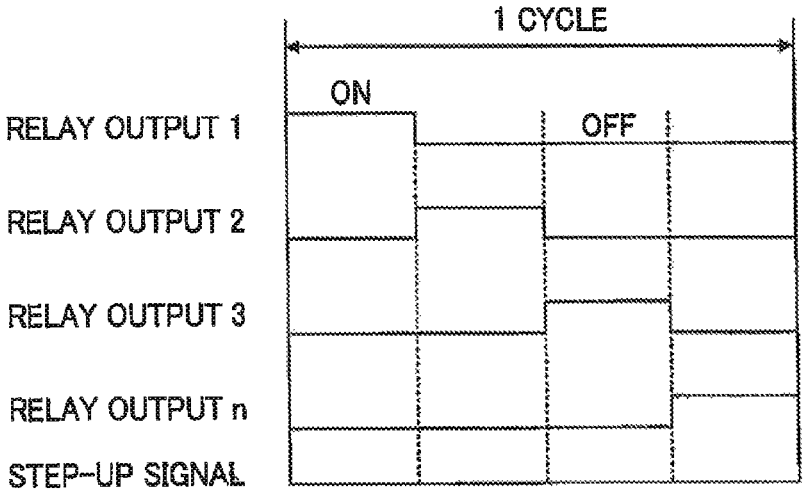
FIG. 11B is a diagram illustrating a time sequence of power-on by the cascade circuit in FIG. 11A.

In the circuit in FIG. 11A, a flicker relay FRY receives an AC input and outputs a step-up signal as a clock signal. The step-up signal is input to a stepping relay SRY1-SRYn, and the stepping relay SRY1-SRYn outputs a turn-on signal with a time delay shown in FIG. 11B to the switching circuits SW1-SWn.

According to the configuration described above, with the heat-generating system of the present embodiment, in a case in which the system includes a plurality of the panel-shaped structures each configured with a heat-generating panel manufactured by the manufacturing method of the present embodiment, failure caused by the rush current to the panel-shaped structures upon power-on can be avoided. Further, by varying the duty ratio of the current to be supplied to the respective panel-shaped structures, regulation of the temperature by heating of the respective panel-shaped structures can be achieved.

Figure 12:
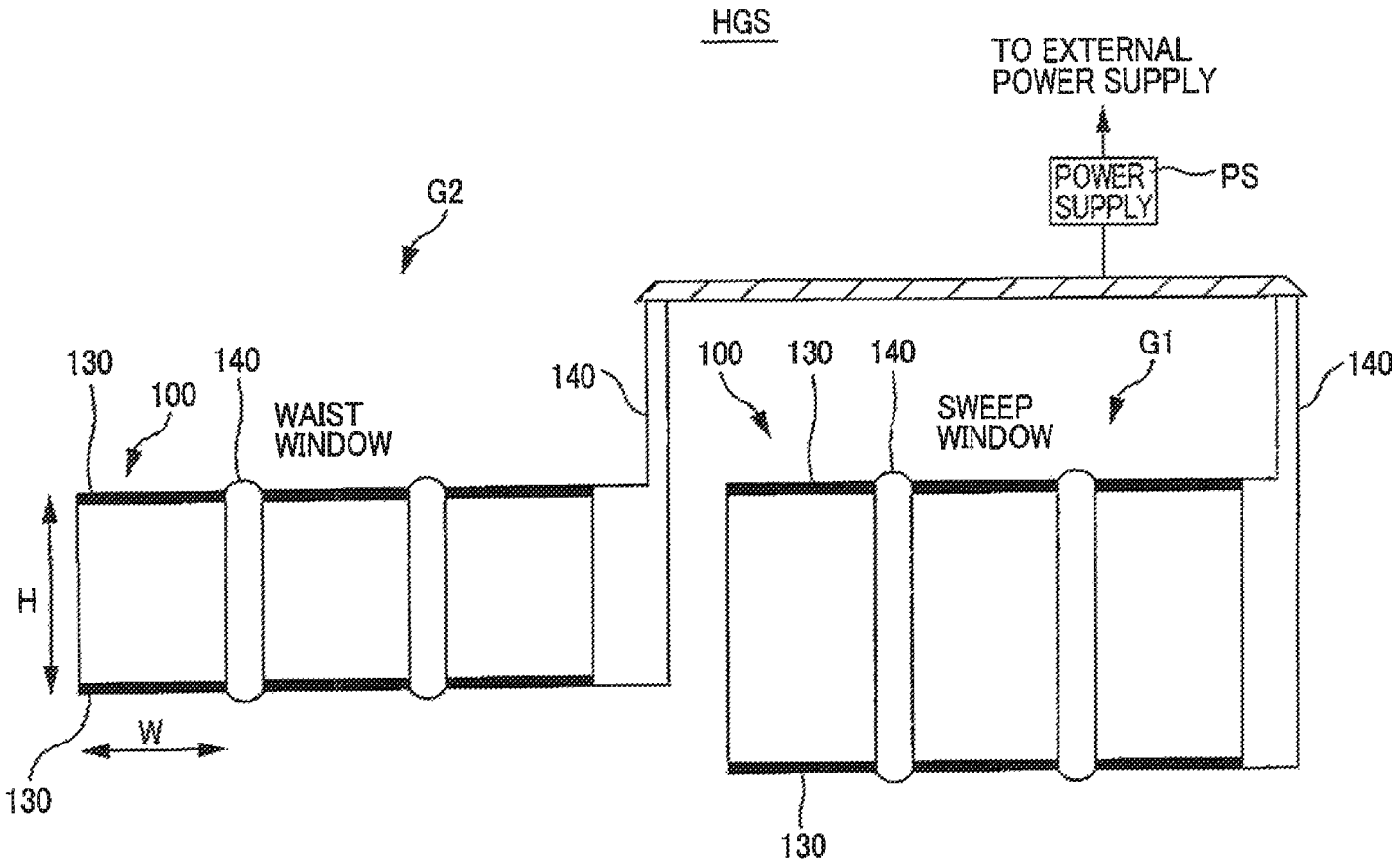
FIG. 12 is a system diagram illustrating a wiring of power supply of the heat-generating system according to an embodiment of the present invention.

Next, the heat-generating system according to another embodiment of the present invention will be described. FIG. 12 is a system diagram illustrating a wiring of power supply of the heat-generating system according to an embodiment of the present invention. In the heat-generating system HGS of the present embodiment, the heat-generating glasses 100 connected to the power supply PS are grouped into two heat-generating glass (heat-generating panel-shaped structure) groups G1 and G2. The group G1 consists of the heat-generating glasses 100 installed in windows out of which dust is swept, hereinafter a "sweep window." The group G2 consists of the heat-generating glasses 100 installed in windows the lower edge of which being positioned about at a height of human waist, hereinafter a "waist window." The height H of the sweep window is greater than that of the waist window. That is, the sweep window has a longer distance between the electrodes 130. In the respective heat-generating glasses 300 included in each group G1, G2, the height H, i.e., a distance between the opposing electrodes 130 and the width W, i.e., a length of each electrode 130, are set substantially equal to each other. In each group G1, G2, the lead wires 140 are so connected to the power supply PS electrically that the respective heat-generating glasses 100 are connected to the power supply PS in parallel. Though not shown, it is possible to allow coexistence of a plurality of heat-generating glasses 100 of almost equal height H and of mutually different widths W, and to connect the heat-generating glasses 100 to the power supply PS in parallel.

Employment of the above configuration is because a heating temperature or a temperature rise by electric power of the heat-generating glass 100 depends on an electric power density, that is, the amount of electric power supplied to the glass per unit area. If a plurality of the heat-generating glasses 100 of almost equal height H and almost equal width W are connected to the power supply PS in parallel, it is possible to obtain a substantially identical heating temperature as to the respective heat-generating glasses 100 without providing any particular regulating circuit.

According to the configuration of the present embodiment, in the heat-generating system including a plurality of the panel-shaped structures each configured with a heat-generating panel manufactured by the manufacturing method according to one aspect of the present invention, the volume of wiring required for connecting the power supply to the respective panel-shaped structures can be reduced. Further, failure caused by the rush current to the panel-shaped structures upon power-on can be avoided. Further, it is possible to obtain a substantially identical heating temperature as to the respective panel-shaped structures without providing a particular regulating circuit.

Each of the aspects of the present invention has been described in detail with reference to the respective embodiments. However, the present invention is not limited to the embodiments, and a person skilled in the art can make various improvements, modifications thereto within the scope of the present invention.

The invention claimed is:

1. A method of manufacturing a heat-generating panel having an electrically-conductive thin layer provided on at least one surface of a translucent plate and the electrically-conductive thin layer is caused to generate heat by supplying electric power to the same, comprising:

fixing a metal strip onto the electrically-conductive thin layer formed on the plate along each of the opposing sides of the plate;

applying an electrically-conductive paste over each of the metal strips to cover the same;

contacting a heat-generating portion of a heating device at edges forming the two sides of the plate where the metal strip is fixed in a state in which a temperature of the heat-generating portion is above a predetermined temperature, the heat-generating portion being longer than at least a full length of the metal strip, heat-generating and curing the electrically-conductive paste to form electrodes having the metal strip and the electrically-conductive paste; and connecting a conductor wire electrically to each of the electrodes.

2. The method of manufacturing the heat-generating panel according to claim 1, wherein that the heat-generating portion of the heating device has a heat-generating part of a flexible thin plate shape so as to closely contact the edge of the plate and an elastic member supporting the heat-generating part so that the heat-generating part is pressed against the edge of the plate.

* * * * *